US005548879A

United States Patent [19]

Wu

[11] Patent Number: 5,548,879

[45] Date of Patent: Aug. 27, 1996

[54] FASTENER DEVICE

[76] Inventor: Chen-Chuan Wu, 4F, No. 56, Lane 296, Sec. 6, Ming Chiuan E. Rd., Taipei, Taiwan

[21] Appl. No.: 436,533

[22] Filed: May 8, 1995

[51] Int. Cl.[6] ..... A44B 11/25

[52] U.S. Cl. ..... 24/625; 24/616; 24/633

[58] Field of Search ..... 24/625, 618, 614, 24/604, 616, 633, 643, 323, 313, 176, 171, 305, 307, 315

[56] References Cited

U.S. PATENT DOCUMENTS

| | | | |
|---|---|---|---|
| 2,903,774 | 9/1959 | Harley | 24/307 X |
| 4,912,950 | 4/1990 | Crowle | 24/625 |
| 4,991,272 | 2/1991 | Bianchi | 24/616 |
| 5,144,725 | 9/1992 | Krauss | 24/625 |
| 5,311,649 | 5/1994 | Suh | 24/616 X |
| 5,319,836 | 6/1994 | Ida | 24/625 |
| 5,383,257 | 1/1995 | Krauss | 24/625 |
| 5,419,020 | 5/1995 | Murai | 24/633 X |
| 5,444,899 | 8/1995 | Koppelomäki | 24/625 |
| 5,465,472 | 11/1995 | Matoba | 24/625 |
| 5,471,716 | 12/1995 | Takahashi | 24/625 X |

*Primary Examiner*—Peter M. Cuomo
*Assistant Examiner*—Robert J. Sandy
*Attorney, Agent, or Firm*—Bacon & Thomas

[57] ABSTRACT

A fastener device including a male fastener, a female fastener and a lock button. The male fastener has a pair of opposite outward projecting pressing latch boards integrally formed at two front ends thereof. Each pressing latch board has an integral inward projecting latch lug formed with a middle notch. The lock button is rotatably disposed on a latch seat of the female fastener and has a boss formed with lock blocks, whereby the lock button can be rotated to make the lock blocks of the boss thereof engaged into the notches of the latch lugs of the male fastener, so that the pressing latch boards of the male fastener are prevented from being withdrawn and unlocked from the latch seat of the female fastener by external force to achieve a reliable locking effect.

1 Claim, 6 Drawing Sheets

FASTENER DEVICE

BACKGROUND OF THE INVENTION

The present invention relates to an improved fastener device for belt fastening, and more particularly to a fastener device in which the pressing latch boards of the male fastener are prevented from being withdrawn and unlocked from the latch seat of the female fastener by unexpected external force to provide a reliable locking effect.

A conventional fastener device is shown in FIGS. 1 and 2, wherein the fastener device includes a male fastener 1 having an engaging portion 11 and a female fastener 2 having an engaging portion 21. A pair of pressing latch boards 12 are disposed at a front section of the engaging portion 11 of the male fastener 1. Each pressing latch board 12 has an inward projecting engaging latch lug 121. A guide block 13 is integrally formed on the male fastener 1 between the latch lugs 121. The female fastener 2 has a front latch seat 25. Two latch sockets 24 are formed on two sides of the latch seat 25 respectively. A slidable lock device 3 having a push botton 31 exposed on an tip of the femake fastener 2, is disposed on the latch seat 25 in a receptacle 23 of the female fastener 2. On two sides of the lock button 3 beside the receptacle 23 are disposed two L-shaped lock blocks 22. When the male fastener 1 is fitted into the latch seat 25 of the female fastener 2, the guide block 13 of the male fastener 1 is smoothly inserted into the receptacle 23 of the female fastener 2 with the pressing latch board 12 locked in the latch socket 24 of the latch seat 25. At this time, the channels 14 of the pressing latch board 12 are engaged with the lock blocks 22 of the female fastener 2. As shown in FIGS. 1 and 2, the slidable lock device 3 in the latch seat 25 of the female fastener 2 is pushed forward to make the lock blocks 22 of the slidable lock device 3 abut against the latch lugs 121 of the pressing latch board 13 of the male fastener 1 so that the pressing latch board 12 is not easy to be pressed inward by external force. Reversely, when the push button 31 of the slidable lock device 3 is pushed backward to make the latch lugs 121 disengaged from the engaging blocks 31, the pressing latch board 12 of the male fastener 1 can be pressed inward by external force and thus the male fastener 1 can be detached from the latch seat 25 of the female fastener 2. According to the above arrangements, several shortcomings in use exist as follows:

1. While the push button 32 of slidable lock device 3 is exposed on an outside of the fastener surface. It will easily be moved to unlocked position by unexpected external force.

2. When the latch lugs 121 of the pressing latch board 12 of the male fastener 1 are engaged with the engaging blocks 31 of the lock button 3 of the female fastener 2 in a locked state. If a raging force is exerted onto the pressing latch board 12, the slidable lock device 3 will be forced to move backward into an unlocked state.

3. In case a raging force is exerted onto the pressing latch board 12, the latch lugs 121 will be broken to lose the locking function.

4. The conventional fastener device is relatively complicated in structure and the mold therefor cannot be easily made. This results in higher manufacturing cost.

SUMMARY OF THE INVENTION

It is therefore a primary object of the present invention to provide an improved fastener device to eliminate the above shortcoming that the pressing latch board is subject to unexpected external force to make the slidable lock device unlocked or lead to breakage of the latch lugs.

It is a further object of the present invention to provide the above improved fastener device which is more firmly and reliably locked and can be mass-produced at low cost.

The present invention can be best understood through the following description and accompanying drawing, wherein:

DETAILED DESCRIPTION OF THE PREFERRED EMBODIMENT

Figure 1:
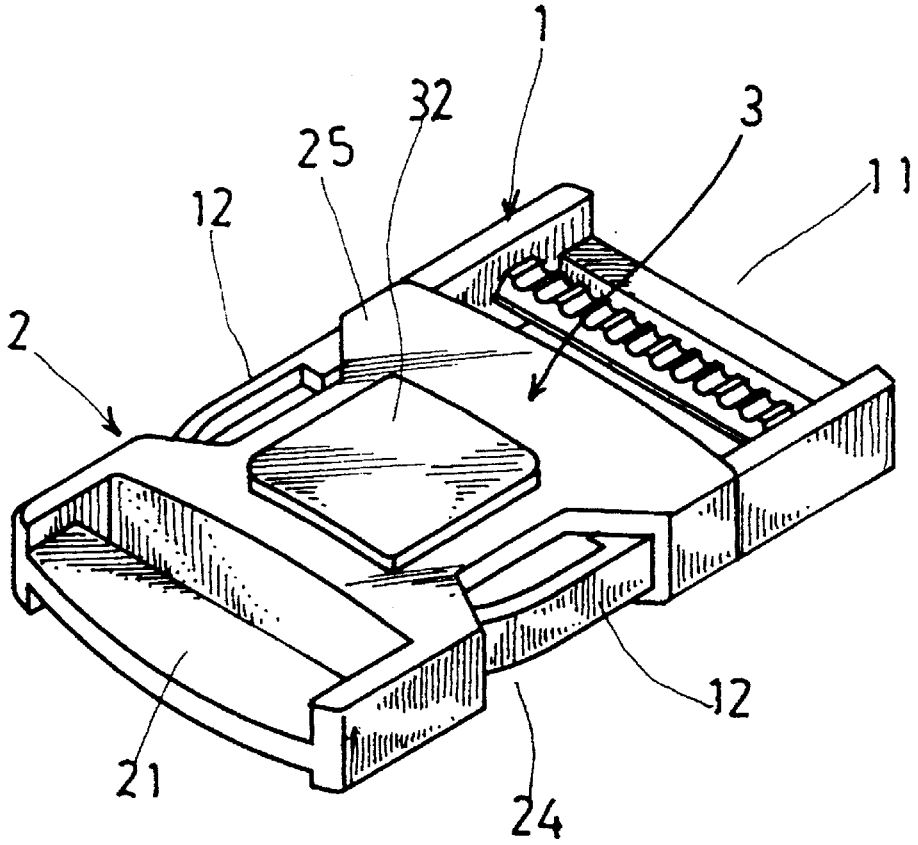
FIG. 1 (PRIOR ART)
FIG. 1 is a perspective assembled view of a conventional fastener device.
Figure 2:
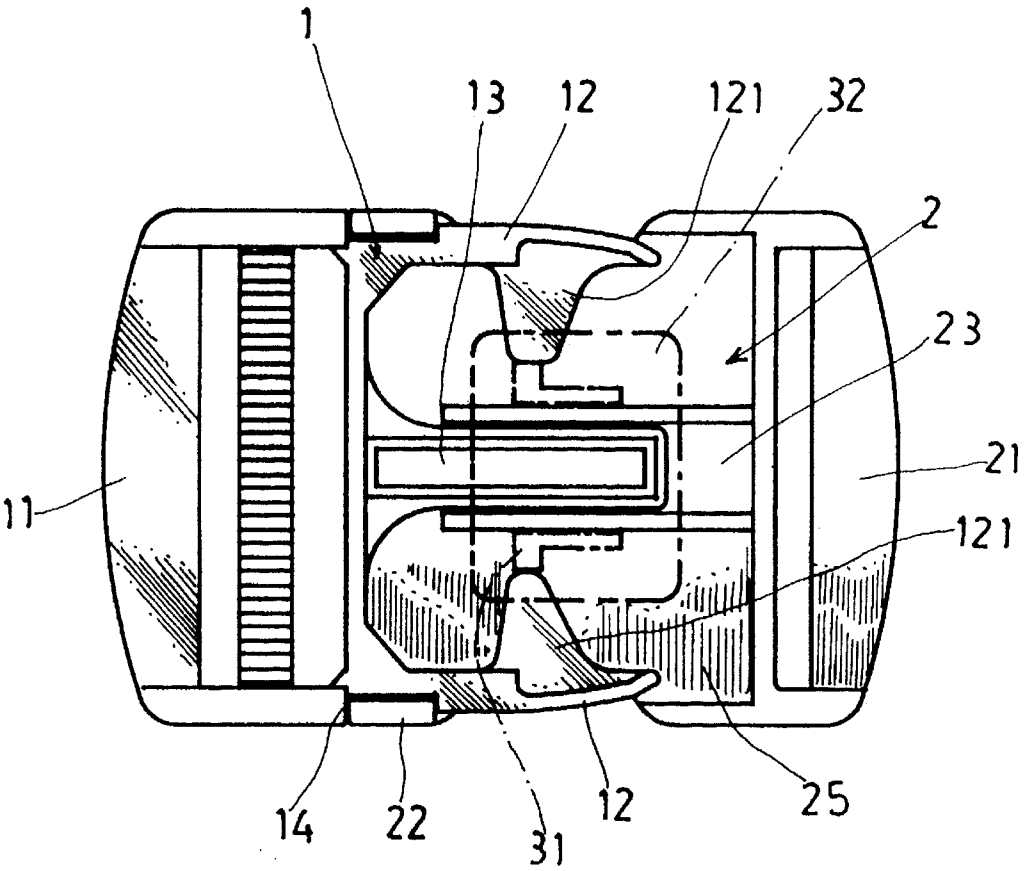
FIG.2 (PRIOR ART)
FIG. 2 is a sectional view according to FIG. 1.
Figure 3:
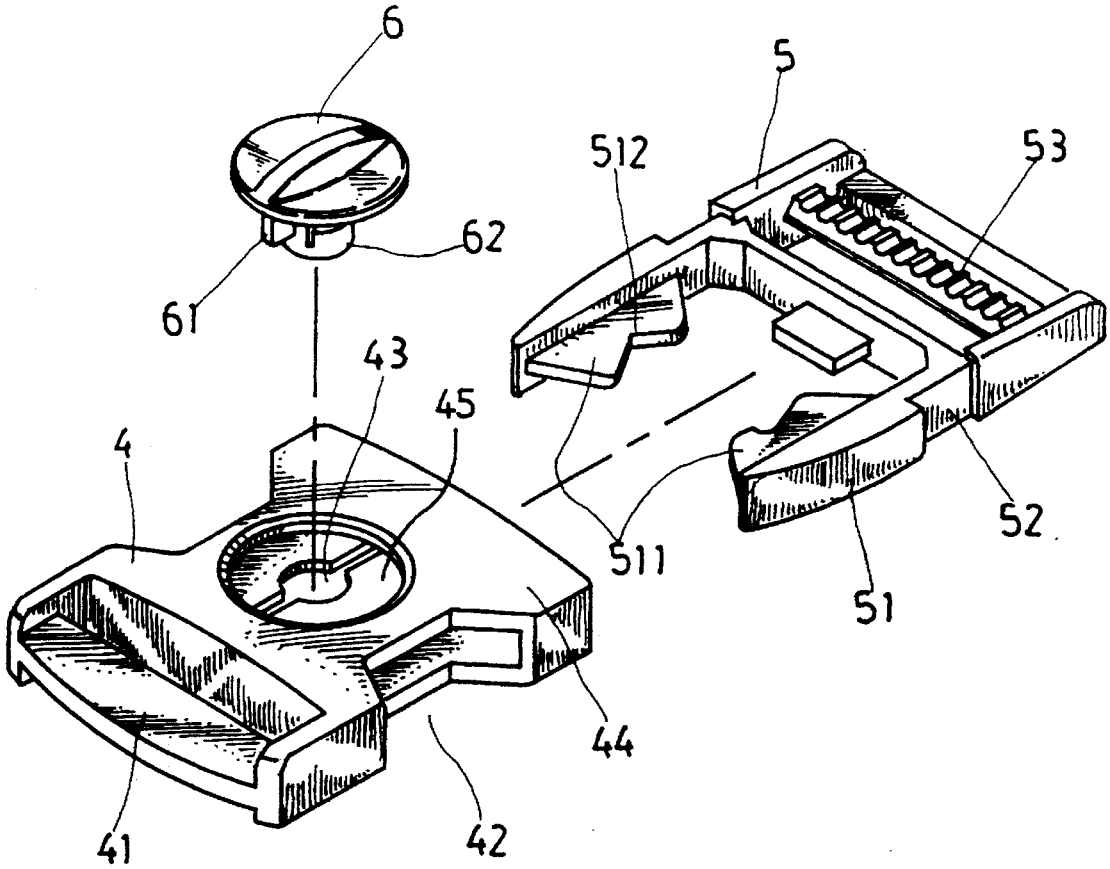
FIG. 3 is a perspective exploded view of the present invention.

Please refer to FIG. 3. The fastener device of the present invention includes a male fastener 5 and a female fastener 4 respectively having belt connecting portions 53, 41. A pair of opposite outward projecting pressing latch boards 51 are integrally formed at two front ends of the belt connecting portion 53 of the male fastener 5 and a pair of recesses 52 are formed behind the pressing latch 5 boards 51. Each pressing latch board 51 has an integral inward projecting latch lug 511 formed with a middle notch 512. An integral latch seat 44 is formed at a front end of the belt connecting portion 41 of the female fastener 4. Two latch sockets 42 are respectively formed 10 on two sides of the latch seat 44 and a circular depression 45 is formed on an upper face of the latch seat 44. A key hole 43 is formed on a central portion of a circular depression 45 on an upper face of the femake fastener. A swivel lock knob 6 is recieved in the circular depression 45 having a boss 62 and a pair of opposite 15 lock blocks 61 are integrally formed on the boss 62, which can be inserted into the key hole 43.

Figure 4:
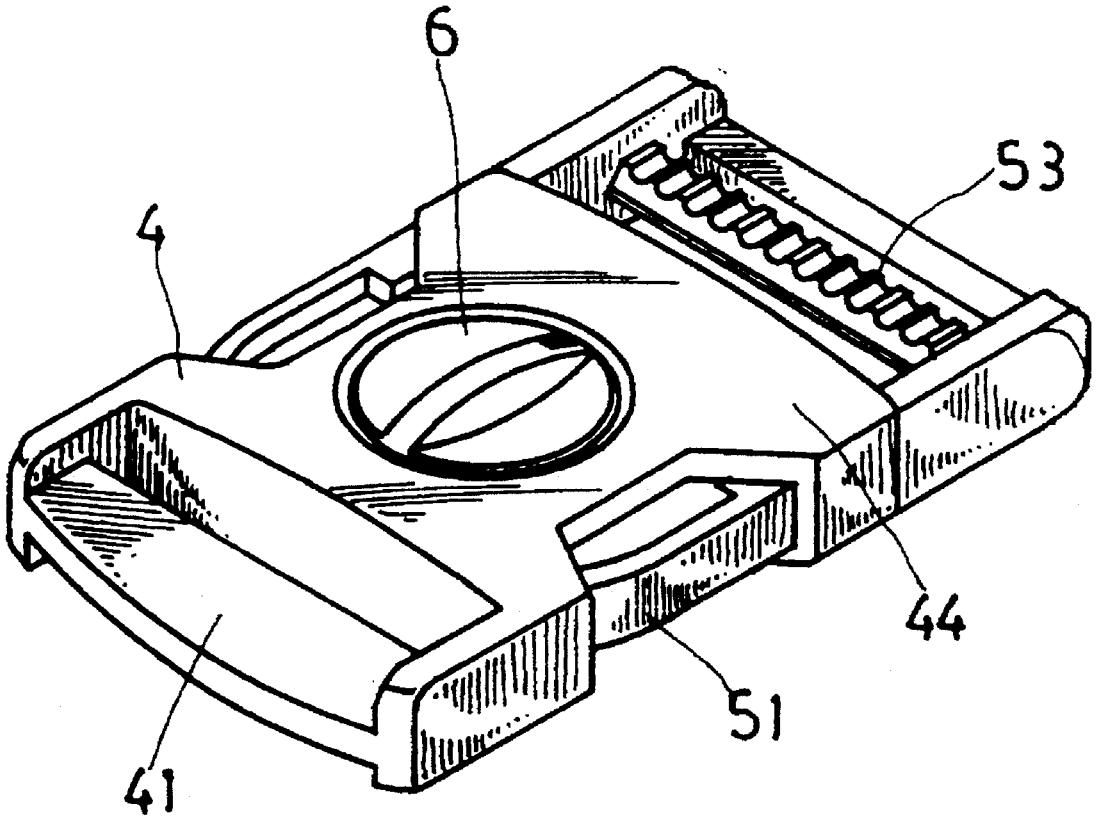
FIG. 4 is a perspective assembled view according to FIG. 3.
Figure 5:
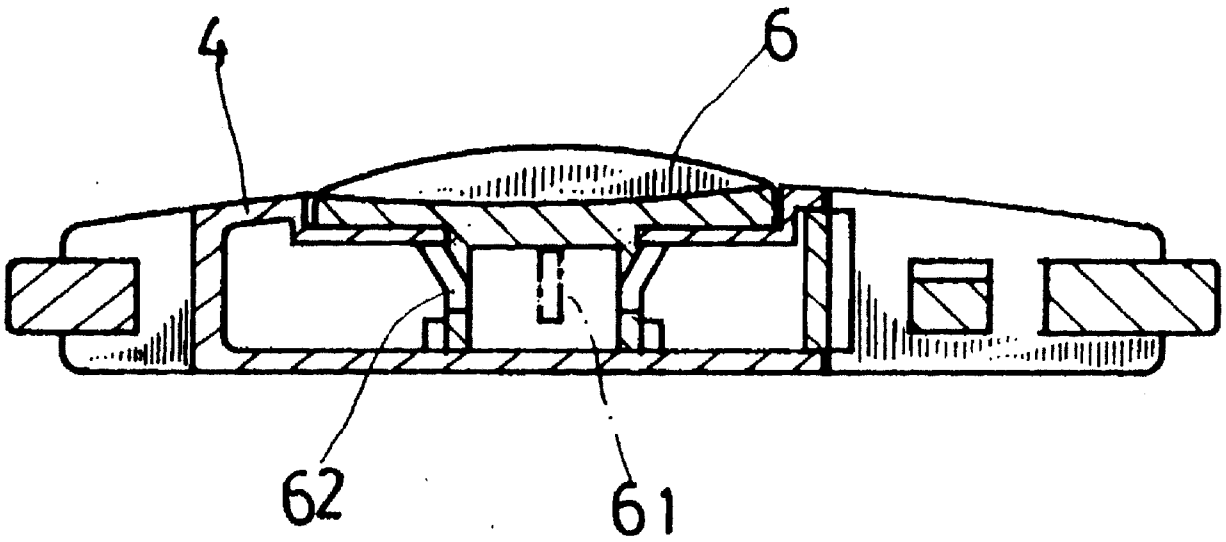
FIG. 5 is a side sectional view according to FIG. 4.
Figure 6:
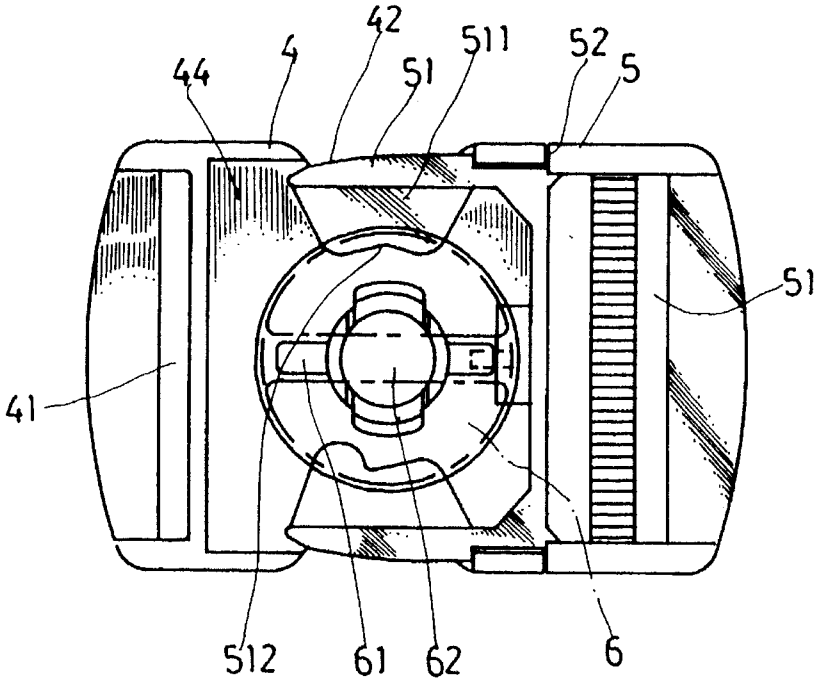
FIG. 6 is a top sectional view according to FIG. 4, showing an unlocked state of the present invention.

Please refer to FIGS. 4, 5 and 6. When assembled, the pressing latch boards 51 of the male fastener 5 are fitted into the latch seat 44 of the female fastener 4 and locked in the latch sockets 42 thereof. At this time, the recesses 52 of the male fastener 5 are engaged with the latch seat 44. This is a first stage of locking action. Accordingly, when two fingers of a user press the pressing latch boards 51 in the latch sockets 42 of the latch sockets 44 of female fastener 4, the pressing latch boards 51 can be detached from the latch seat 44 of the female fastener 4.

Figure 7:
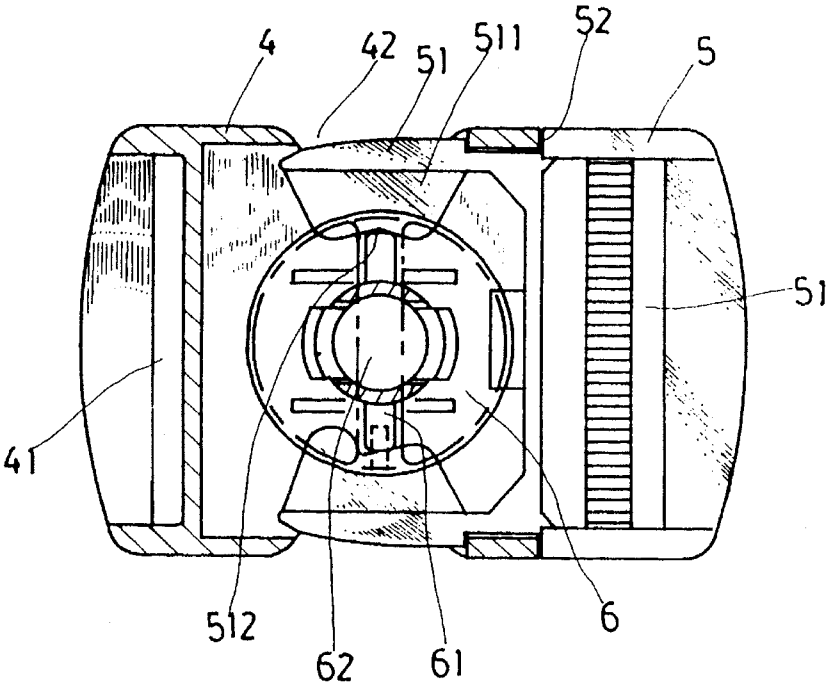
FIG. 7 is a top sectional view according to FIG. 4, showing a locked state of the present invention.

Please refer to FIG. 7. When the male fastener 5 is assembled with the female fastener 4, the swivel lock knob 6 can be rotated to make the lock blocks 61 of the boss 62 5 thereof engaged into the notches 512 of the latch lugs 511 of the male fastener 5, so that the pressing latch boards 51 of the male fastener 5 are prevented from being withdrawn and unlocked from the latch seat 44 of the female fastener 4 by external force.

Accordingly, the fastener device of the present invention can be reliably and firmly locked without breakage resulting from external force.

It is to be understood that the above description and drawings are only used for illustrating one embodiment of the present invention, not intended to limit the scope thereof. Any variation and derivation from the above description and drawings should be included in the scope of the present invention.

What is claimed is:

1. A fastener device comprising:

a male fastener having a belt connecting portion, a pair of opposite outward projecting pressing latch boards integrally formed at two front ends of said belt connecting portion, and a pair of recesses behind said pressing latch boards, each pressing latch board having an integral inward projecting latch lug formed with a middle notch;

a female fastener having belt connecting portion, an integral latch seat being formed at a front end of said belt connecting portion of side female fastener, two latch sockets being respectively formed on two sides of said latch seat and a circular depression being formed on an upper face of said latch seat, a key hole being formed on a central portion of said circular depression; and a swivel lock knob received in said circular depression of said female fastener characteristically having a central boss integrally formed with a pair of opposite lock blocks for rotatably fitting into said key hole of said circular depression of said latch seat, whereby after said male fastener is assembled with said female fastener, said swivel lock knob can be rotated and pushed to make said lock blocks of said boss thereof engaged into said middle notches of said latch lugs of said male fastener, so that said pressing latch boards of the male fastener are prevented from being withdrawn and unlocked from said latch seat of said female fastener by unexpected external force.

* * * * *